US005558306A

United States Patent [19]

Binford et al.

[11] Patent Number: 5,558,306

[45] Date of Patent: Sep. 24, 1996

[54] INCLINED SURFACE SUPPORT PLATFORM

[76] Inventors: Robert S. Binford, 451 Cotuit Bay Dr.; Gregg A. Binford, 923 Main St., both of Cotuit, Mass. 02635

[21] Appl. No.: 367,579

[22] Filed: Jan. 3, 1995

[51] Int. Cl.[6] ..... A47G 23/02

[52] U.S. Cl. ..... 248/148; 248/237; 248/238; 248/311.2

[58] Field of Search ..... 248/148, 237, 248/238, 311.2; 182/42

[56] References Cited

U.S. PATENT DOCUMENTS

| | | | |
|---|---|---|---|
| 590,949 | 9/1897 | Wilken | 248/148 |
| 789,034 | 5/1905 | Jones | 248/238 |
| 989,104 | 4/1911 | Anderson | 248/148 |
| 1,159,372 | 11/1915 | Goff | 248/148 |
| 1,326,896 | 12/1919 | Anderson | 182/42 |
| 2,912,205 | 11/1959 | Toune | 248/311.2 |
| 3,182,943 | 5/1965 | Crossman | 248/311.2 |
| 3,285,557 | 11/1966 | Reda | 248/311.2 |
| 3,448,956 | 6/1969 | Kuhaneck, Jr. | 248/311.2 |
| 3,458,165 | 7/1969 | Crow | 248/311.2 |
| 3,642,240 | 2/1972 | Hershey | 248/311.2 |
| 3,980,264 | 9/1976 | Tomasik | 248/311.2 |
| 4,047,686 | 9/1977 | Porter | 248/552 |
| 4,094,416 | 6/1978 | Smith | 248/311.2 |
| 4,519,565 | 5/1985 | Whitmore | 248/237 |
| 4,695,023 | 9/1987 | McCafferty | 248/148 |
| 4,796,849 | 1/1989 | Fouassier | 248/619 |
| 4,842,229 | 6/1989 | Murray | 248/148 |
| 4,862,994 | 9/1989 | Hughes, Sr. | 248/238 |
| 4,962,906 | 10/1990 | Fatool et al. | 248/148 |
| 4,976,055 | 12/1990 | Kane | 248/206.5 |
| 5,217,193 | 6/1993 | Drucker | 248/148 |
| 5,232,187 | 8/1993 | O'Farrell et al. | 248/148 |
| 5,249,397 | 10/1993 | Monaco | 248/148 |
| 5,316,251 | 5/1994 | McGraw | 248/311.2 |
| 5,339,921 | 8/1994 | Faupel | 248/237 |

*Primary Examiner*—Ramon O. Ramirez
*Assistant Examiner*—Michael J. Turgeon
*Attorney, Agent, or Firm*—Richard P. Crowley

[57] ABSTRACT

An inclined surface support platform to hold paint pails or implements, for use on a roof or ladder, with one vertical planar member and one horizontal planar member arranged and secured at right angles to one another by means of a brace on the horizontal member having holes therein to correspond with two elongated, spaced apart parallel slots in the vertical member. Bolts are inserted through the brace holes in the horizontal member into the slots of the vertical member, and the height of the horizontal member is adjusted as desired, whereupon wing nuts with washers are tightened and the support platform is ready for use. Non-slip friction-engaging means are positioned at the lower end of the vertical member and the extended end of the horizontal member to prevent slippage of the platform in use. An open handle is located in the top central portion of the vertical member for purposes of transport. The support platform has openings on the horizontal surface for insertion of a paint pail and other implements, allowing the user to have at least one hand free while working. The platform can be easily disassembled and reassembled and can be arranged with the two planar members resting against one another in a parallel fashion and secured with the bolts and nuts for carrying purposes by the user.

19 Claims, 4 Drawing Sheets

INCLINED SURFACE SUPPORT PLATFORM

BACKGROUND OF THE INVENTION

There are a wide variety of supports used for providing a horizontal surface on an inclined surface, such as, for example, an inclined roof platform. Such platforms permit a worker to carry out a number of work projects while on the inclined roof, yet permits paint containers or tools to be supported on a generally horizontal portion of the inclined roof platform. Several of the prior art inclined roof platforms are adjustable, that is, they may easily be assembled and disassembled and constitute knock-down type work platforms. However, many of the prior art adjustable roof platforms are not wholly satisfactory, particularly in connection with use by a painter, and are not sufficiently lightweight, sturdy, or easily assembled or disassembled for optimum work performance.

Therefore, it is desired to provide for a new and improved inclined roof support platform, particularly for use by painters. The support platform is easily assembled and disassembled, lightweight in nature, sturdy and effective, and provides stable support for a paint pail on the support platform.

SUMMARY OF THE INVENTION

The invention relates to a support platform, and in particular to an inclined roof support platform for use by a painter, and to a support platform which is easily assembled and disassembled.

The invention concerns a support platform for use on an inclined or non-horizontal surface, but more particularly on a roof or ladder, and in particular, but not limited to, use as a paint pail support platform for use by a painter, carrying out projects on an inclined surface, such as the painting of a window sill trim or chimney of a building. The roof support platform of the invention permits a user, such as a painter, to have at least one hand free while standing or working on a roof or ladder, and yet have one or more stably positioned paint pails and tools available. In one embodiment, the support platform is designed to contain therein a metal paint bucket or can, with, for example, disposable paper liners, and having, optionally if desired, holes in the support for holding various types and sizes of brushes and knives and other implements or tools used by painter or others, such as roofers or carpenters. The roof support platform may be composed in one embodiment of lightweight, integrally molded hard plastic, two-pieces which are easily assembled and placed at right angles to each other, but which components are adjustable to conform to a wide variety of roof angles. The support platform also has a anti- or no-slip foot design on both ends, so that the support platform may be left unattended without danger of upset and the danger of spilling paint from the stable paint support platform. The support platform in particular allows a user to have a hands-free approach, therefore creating a more effective and safer work performance situation. The support platform is easily placed between a disassembled, carrying non-use position and an easily assembled, adjustable in height use position as a practical and essential tool as a roof support platform.

The support platform of the invention comprises a support platform device adapted to be placed in an upright, generally vertical position, for use on an inclined surface such as a roof or ladder. The support platform comprises a first vertical planar member having a one lower and a one upper end, and a second horizontal planar member having a one extended end and an other secured end. The horizontal planar member is secured to and extended in operation at a right angle from the vertical member in a height-adjusting relationship, with the horizontal member characterized by at least one opening in the planar member such as to receive or hold a paint pail therein, such as a standard metal paint pail used by a painter, but may also include a number of openings therein to hold a variety of pails or tools as required for the particular user of the support platform.

The support platform includes a non-slip surface, friction-engaging plastic foam means at the one lower end of the vertical member and at the one extended end of the horizontal member to retain the support platform in position on an inclined surface such as that of a roof, or on a ladder. The horizontal member also includes adjusting means to secure the other secured end of the horizontal member to a selected vertical height portion of the vertical member in an assembled position, and to adjust and secure the desired height of the horizontal member based on the angle of incline of the roof surface on which the support platform is to be employed, so as to provide for adjustability and to provide for the horizontal, adjustably secured member at right angles to the vertical member.

It is desirable in one embodiment that the support platform and the vertical and horizontal planar members are to be integrally molded of a hard, moldable type plastic, such as polystyrene or polycarbonate or the like, such as an engineering-type hard, plastic material, so as to enable the support platform to be easily carried, typically by a handle means at one end of the upright member, generally molded in, as an opening at the end of the vertical member. The support platform may also include a non-slip, friction-engaging means, either the same or different, to secure the extended end of the horizontal member and the lower end of the upright member, normally to the roof and therefore prevents slippage of the support platform in use.

Typically, the friction-engaging means may vast, but in one embodiment it has been found that the employment of a flexible, deformable, foam member on the one lower end and on the one extended end is a satisfactory friction-engaging means. Such friction-engaging means, for example, may be formed of a wide variety of foam plastic material such as an olefinic foam like polyethylene or a urethane foam and may, for example, be composed of tubular foam, typically employed as snap-on pipe insulation covering, wherein the snap-on pipe covering has a single, longitudinal slit throughout the length of the pipe covering. Such pipe covering may then be cut at appropriate lengths, and then snapped on or otherwise fastened, such as by an adhesive, to the end of one lower rounded end and of the other extended rounded end to prevent slippage of the support platform. A double-faced adhesive tape may also be employed on the ends to secure further the foam, to the rounded lower and extended ends of the platforms, which tape is removable and replaceable as needed or desired and which permits the easy replacement of the tubular foam.

In an illustrated embodiment, the vertical planar member is characterized by at least one and typically a pair of spaced apart, generally parallel, longitudinally extending slots therein. Each slot has a recessed groove around its perimeter on the outward facing surface which secures the bolt in place when it is tightened, to provide for further stability of the horizontal member in use. The horizontal member includes a brace element on its lower surface at the other secured end, and having one or more holes therein, which includes a threadable securing means such as a nut and bolt means extending through the holes of the brace element and the slots of the vertical member, so as to threadably retain the horizontal member in a desired height adjustment, in a horizontal use position, through the tightening of the threaded means. Generally, the brace member would be also integrally molded in the horizontal planar member, and the holes therein would be aligned to match the spaced apart slots of the vertical member.

The support platform is easily disassembled and placed in an easy carrying or storage position by merely placing the two component parts generally longitudinally adjacent each other, with the rounded ends in opposite orientation to each other. The two members may then be secured together by the insertion of the threaded means through the slots of the vertical member, the bolts secured within the recessed grooves on the outward facing surface of the slots, and with the sides of the bolts then resting against the edge of the circular opening in the horizontal member, and the washer and nut means holding the two pieces together in a secure fashion.

The invention will be described for the purpose of illustration only, in connection with certain preferred illustrative embodiments; however, it is recognized that persons skilled in the art may make various improvements, changes, modifications and additions to the illustrated embodiments of the invention without departing from the spirit and scope thereof.

DESCRIPTION OF THE EMBODIMENTS

Figure 1:
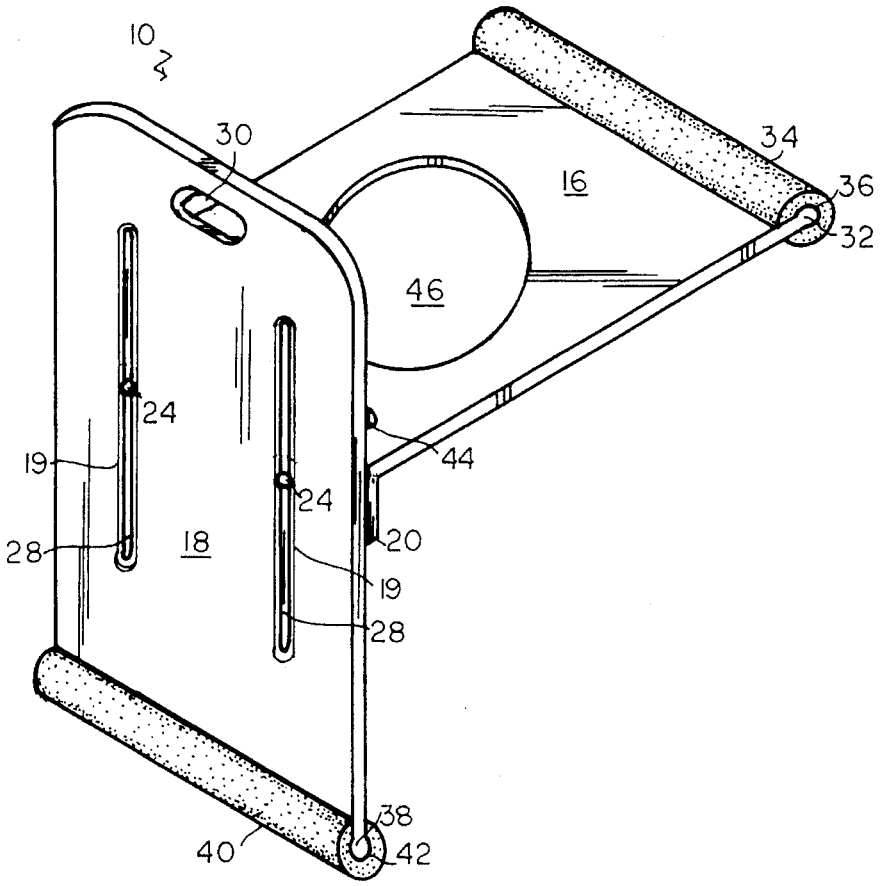
FIG. 1 is a perspective view from above of the back of the assembled inclined surface support of the invention.
Figure 2:
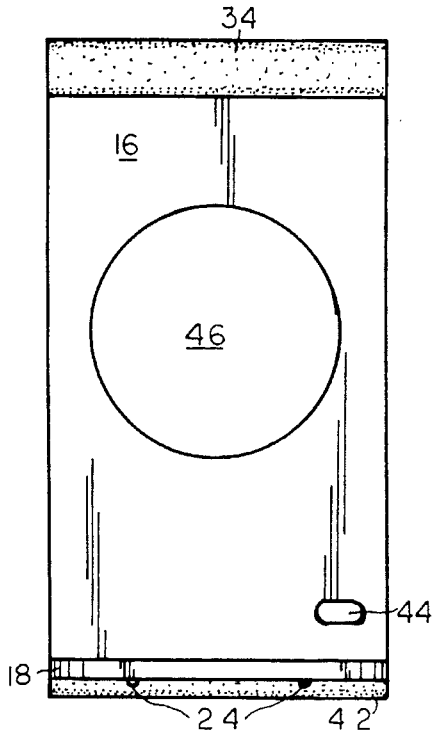
FIG. 2 is a top plan view of the invention of FIG. 1.
Figure 3:
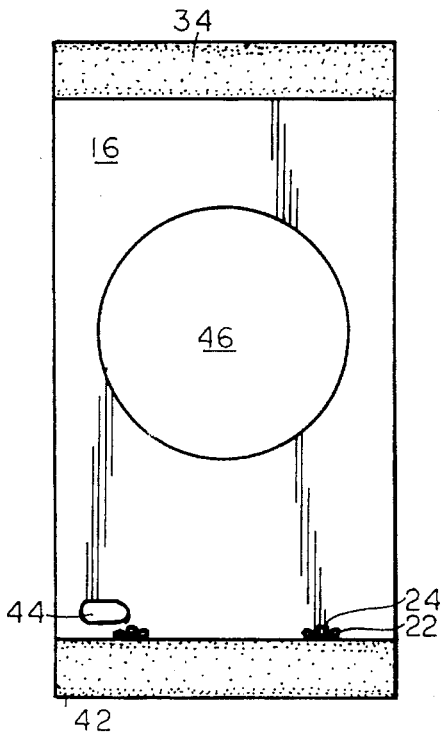
FIG. 3 is a bottom plan view of the invention of FIG. 1.
Figure 4:
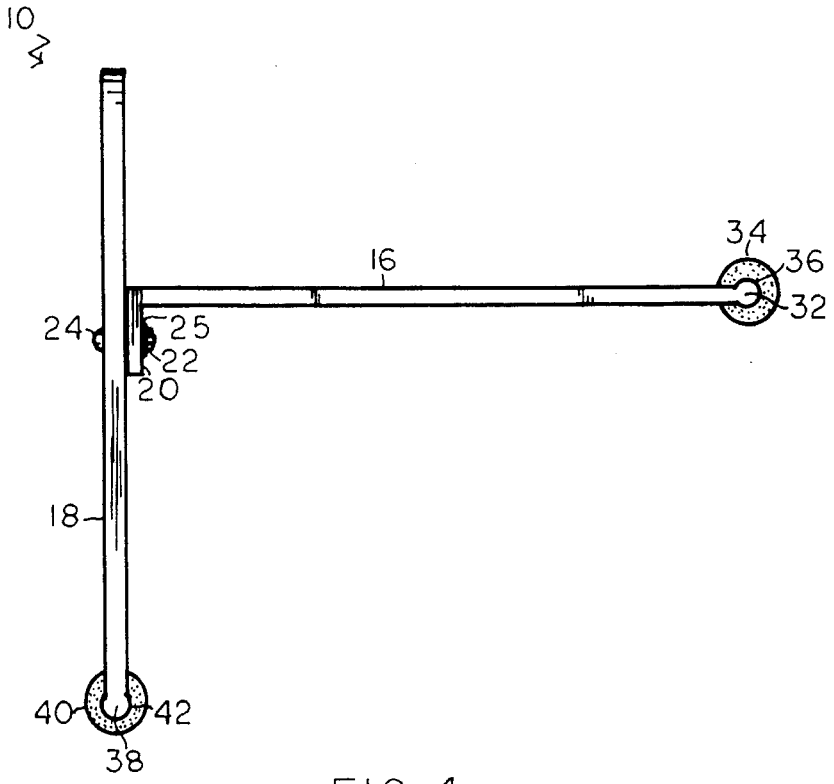
FIG. 4 is a side elevational view of the invention of FIG. 1, with the other side being a mirror image.
Figure 5:
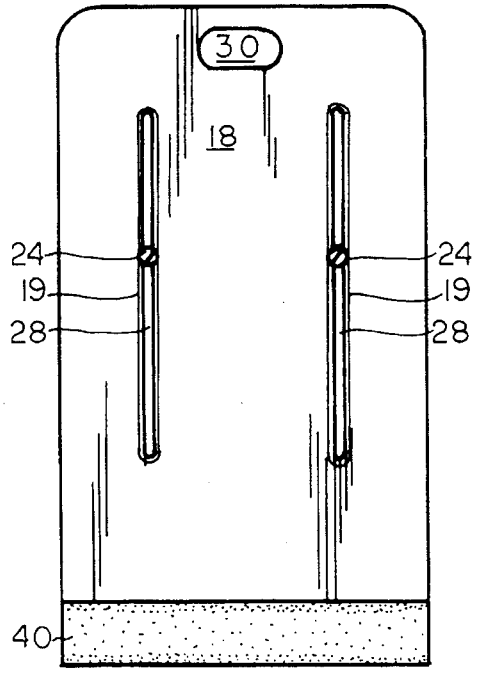
FIG. 5 is a front elevational view of the invention of FIG. 1.
Figure 6:
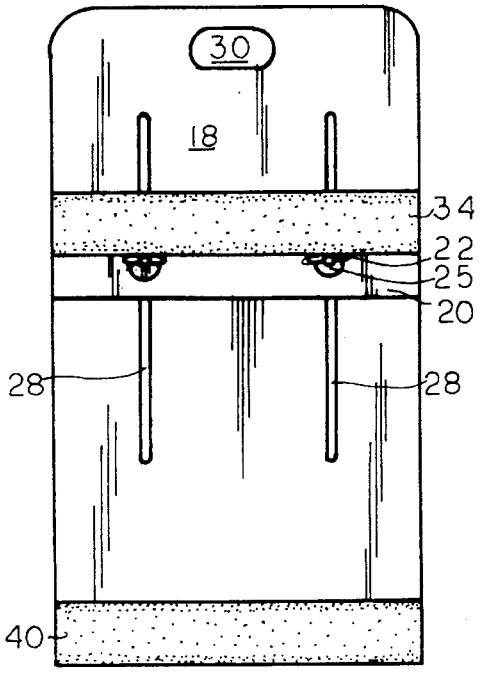
FIG. 6 is a back elevational view of the invention of FIG. 1.

As illustrated in FIGS. 1 - 6, the inclined surface support of the invention 10 is shown in an assembled, use position with a vertical planar member 18 adjustably attached to a horizontal planar member 16 by means of a pair of bolts 24 inserted through two spaced apart, parallel, vertically extending slots 28 in the vertical planar member 18. The vertical planar member 18 has, on its outwardly facing surface around the perimeter of the two slots 28, a recessed groove 19 to secure the bolts 24 so that the bolts will not move when tightened. The two bolts 24 extend through two spaced apart corresponding holes 58 in brace 20, which brace is integrally molded with and perpendicular to the horizontal planar member 16. Recessed grooves 19 hold the bolts 24 in a secure position when inserted fully within slots 28. Two washers 25 and wing nuts 22 are then attached and the wing nuts 22 threadably fastened to the bolts 24 to securely hold the two planar members together. An oval open handle space 30 is cut or molded in the top central portion of the vertical planar member 18 to receive a hand. The horizontal planar member 16 has a generally centrally positioned paint pail receiving circular opening 46 and a paint brush or other tool receiving opening 44 located generally between the pail circular opening 46 and the secured end of the horizontal planar member 16. Other specific tool or pail openings may be provided as desired for any particular use.

At its outer extended end, the horizontal planar member 16 has a rounded end 32 with a rounded, deformable plastic, foam covering 34, such as a polyethylene or urethane foam, ⅜" in thickness and ¾" in diameter, removably attached thereon by means of a double-faced adhesive tape 36. The vertical planar member 18 has, at its lower extended end, a rounded end 38 with a rounded, deformable plastic foam covering 40, such as a polyethylene or urethane foam, ⅜" in thickness and ¾" in diameter, removably attached thereon by means of a double-faced adhesive tape 36.

Figure 7:
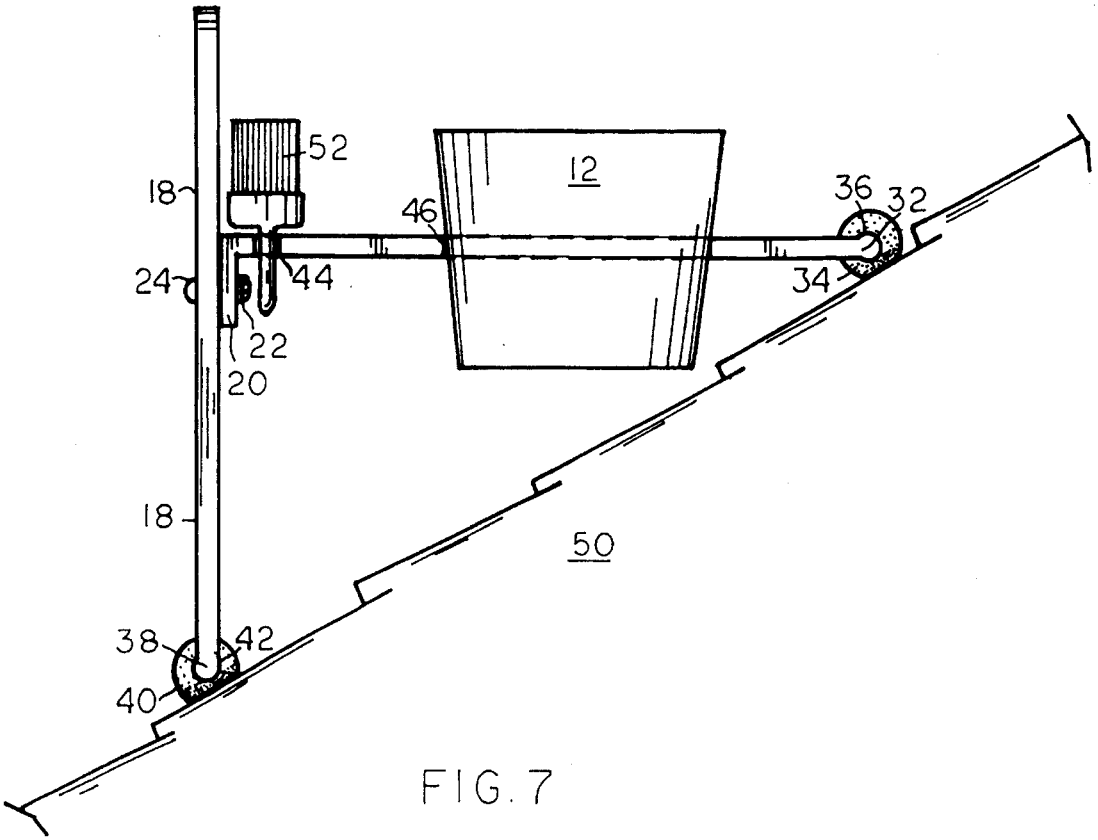
FIG. 7 is a side sectional view of the invention of FIG. 1 on an inclined roof with a pail and brush stored therein.

FIG. 7 shows a side sectional view of the invention 10 in a use position on an inclined roof surface 50, with the rounded foam covered ends being frictionally engaged with the roof surface 50 slightly compressed and further secured thereto by the weight of the paint pail 12 and implements 52. The support 10 is adjusted according to the roof pitch by means of the vertical slots 28 and the bolts 24, washers 25 and wing nuts 22 on the brace 20.

Figure 8:
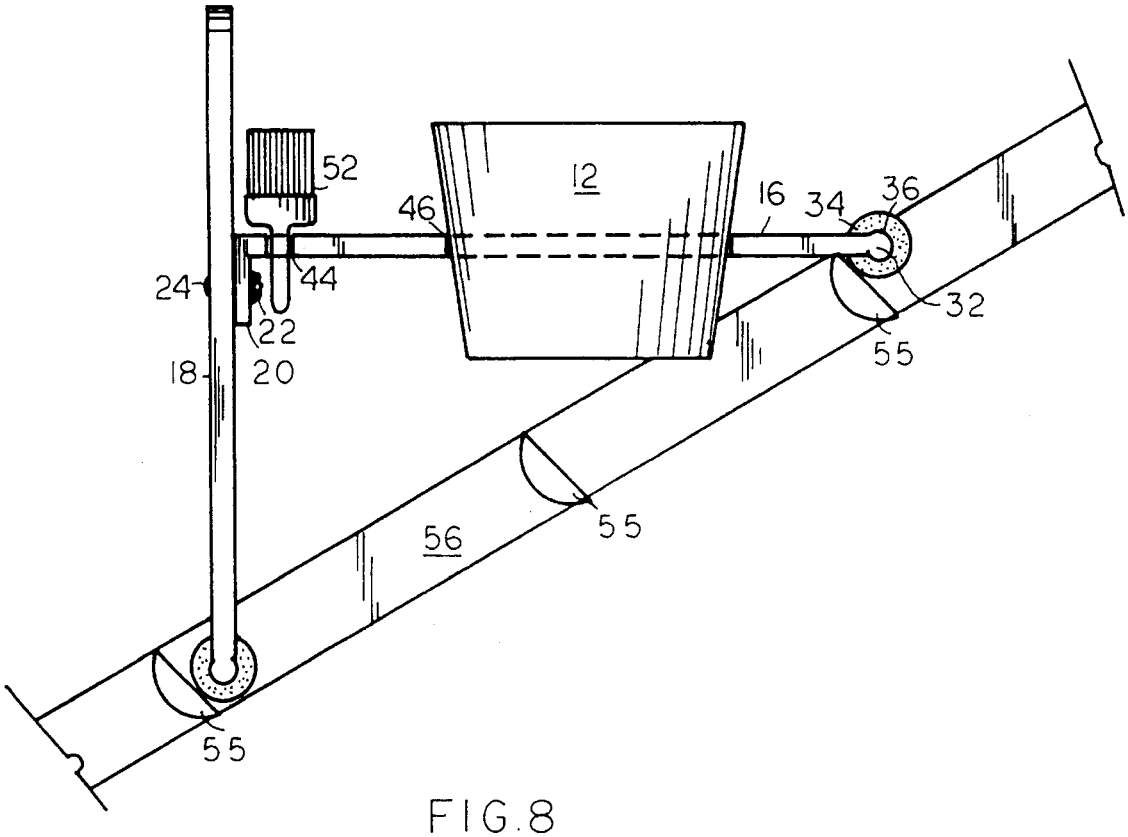
FIG. 8 is a side sectional view of the invention of FIG. I positioned on a ladder with a pail and brush stored therein.

FIG. 8 shows a side sectional view of the paint pail support 10 in a use position on a ladder 56, with the rounded extended ends resting in an interlocked manner with the rungs 55 of the ladder 56. The paint pail support 10 can be positioned adjustably according to the angle of the ladder 56 in the same manner shown in FIG. 7.

Figure 9:
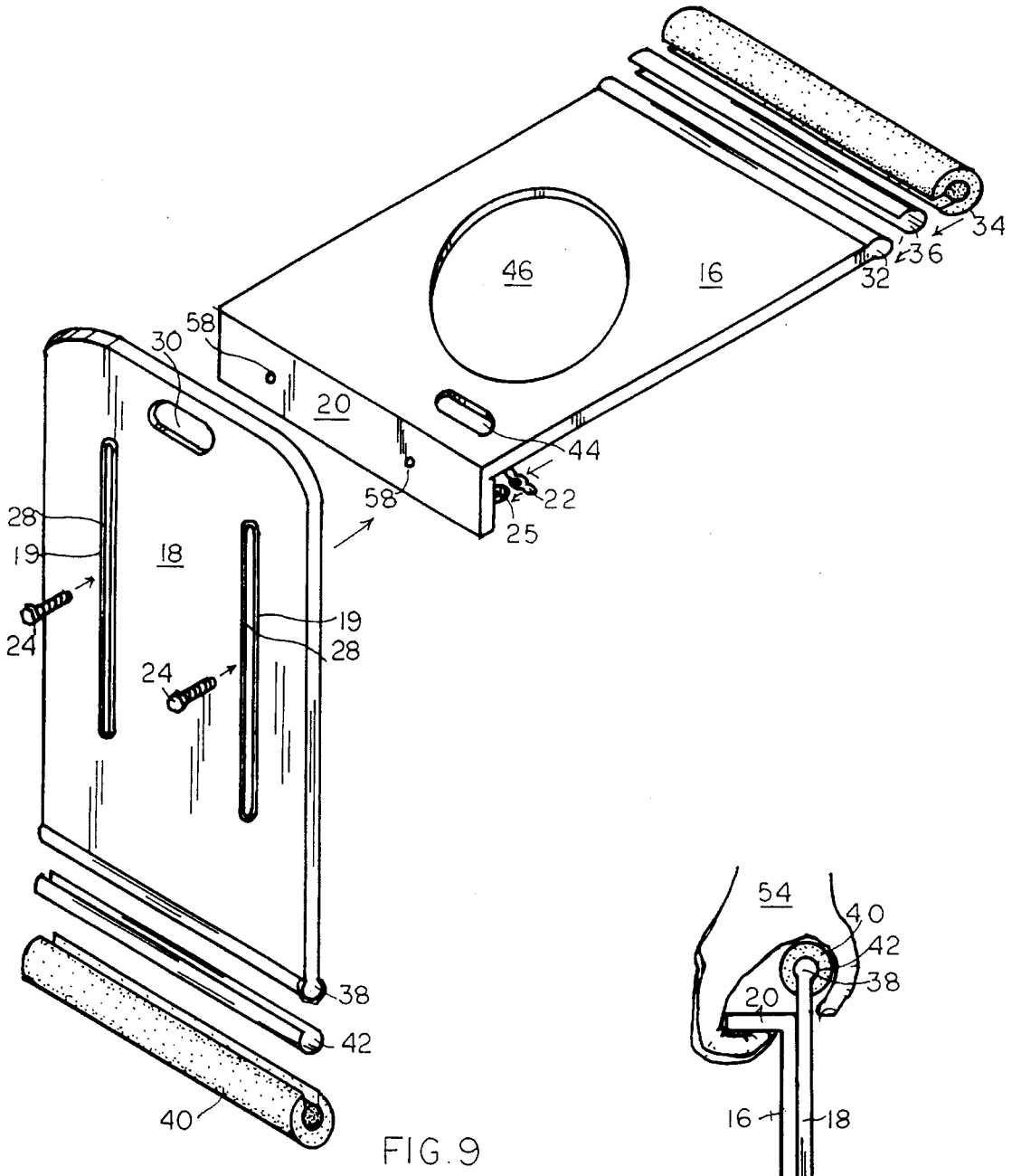
FIG. 9 is an exploded view of the invention of FIG. 1, showing the parts assembly.

FIG. 9 is an exploded view of the paint pail support 10, showing the horizontal planar member 16 with the paint pail-receiving circular opening 46 and the tool receiving opening 44, having the rounded outwardly extending end 32 with adhesive tape 36 and rounded foam covering 34. FIG. 9 also shows the brace 20 at the secured end of the horizontal planar member 16, with bolt holes 58, and the bolts 24, washers 25 and wing nuts 22 in position for insertion and securing. The vertical planar member 18, with recessed grooves 19, is shown with the downwardly extending rounded end 38, the adhesive 42, and the rounded foam covering 40.

Figure 10:
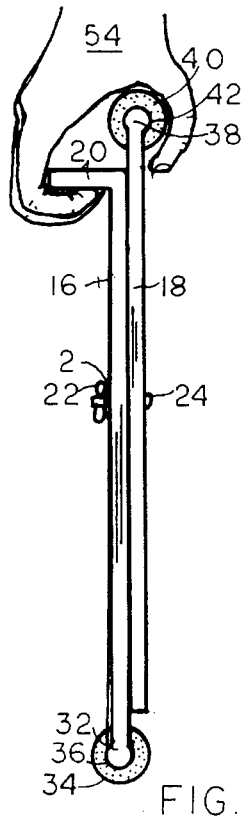
FIG. 10 is a side elevational view of the invention of FIG. 1 in its disassembled, storage and carrying position, with a hand, showing one method of carrying same.

FIG. 10 shows the paint pail support 10 in a storage and transport position, being carried by the hand of a user 54. The two planar members are disassembled with the horizontal planar member 16 secured adjacent the vertical planar member 18 in a snug-fitting manner, with the brace 20 facing out and positioned adjacent the rounded foam end of the vertical planar member 18. The bolts 24 are then inserted through the vertical slots 28 and positioned so that the wing nuts 22 and washers 25, when tightened, fit snugly against the inner edge of the paint pail circular opening 46, securely fastening the two planar members together. In this manner, the paint pail support 10 can be easily carried in the hand of a user 54 and is in a flattened, compact position for storage in a cart or truck.

In operation, a user, such as a painter or carpenter, will carry the paint pail support 10 to a site along with a paint pail 12 and other implements. After climbing the ladder 56 to the roof 50, the user can easily position the paint pail support 10 by means of unscrewing the wing nuts 22 and placing the brace 20 of the horizontal planar member 16 against the vertical planar planar member 18 and inserting the bolts 24 through the vertical member 18 and within the recessed groove 19. After the bolts go through the brace 20, they are secured with the washers 25 and wing nuts 22, tightened sufficiently to place the planar members together in an adjustable fashion. After adjusting the vertical planar member 18 and the horizontal planar member 16 to the pitch of the roof 50 or the angle of the ladder 56 as desired. The user then tightens the wing nuts 22 to secure the paint pail support 10 for use. The user then inserts the paint pail 12 and other implements as desired.

Thus, the user is able to operate in a more comfortable and safe fashion, as the paint pail support leaves at least one of the user's hands free to maintain balance and stability while working. Upon completion of the work, the operation is easily reversed and the paint pail support 10 easily disassembled and reassembled to a storage configuration for carrying or storing as desired.

The removable foam coverings 34 and 40 can be easily and conveniently removed and replaced when necessary due to wear, staining or other damage. The foam pieces employed may be any type of deformable foam, but optionally may be the easy commercially available type of foam covering used for insulation for pipes, which can be easily found and purchased in paint or hardware stores. The foam used in this embodiment is ¾" insulating foam, with 1-¼ double stick adhesive tape, which is also easily found and inexpensively purchased in a hardware or paint store. These pieces fit the ½ diameter rounded ends on both the vertical 18 and horizontal 16 planar members.

In the preferred embodiment, the dimensions of the paint pail support 10 are 16" by 9" for the vertical planar member 18 and for the horizonal planar member 16. The location of the paint pail circular opening 46, which opening is 6" in diameter, is specific and must be 2" from the side edges and 3-¼" from the secured edge. These measurements are specific to allow for the proper position of a paint pail 12 within the circular opening 46 so as not to interfere with the roof 50 or ladder 56; and further for the positioning of the bolts 24 through the paint pail circular opening 46 when the vertical 18 and horizonal 16 planar members are placed in the carrying position. While the size and number of openings may be varied as desired, and the overall size of the support platform may be increased or decreased, the ratio of the specific measurements would stay the same.

The paint pail support 10, as described and illustrated, thus allows for an attractive, easy-to-use, inexpensive apparatus to allow a user to conduct a painting or construction project in a safer and easier manner, with at least one hand free. The support is easy to assemble and use, and the removable and replaceable parts are also easy to assemble and disassemble, are inexpensive to purchase, and readily available.

What is claimed is:

1. An adjustable support platform for a pail or tools for use on an inclined surface such as a roof or ladder, which support platform comprises:

a) a vertical planar member having a first lower end and a second upper end;

b) a horizontal planar member having a first extended end and a second secured end, said horizontal planar member adapted to be secured to an extend horizontally at a right angle from said vertical planar member in a height-adjusting relationship; and said horizontal planar member characterized by at least on opening in said horizontal planar member to receive and hold a pail or a tool;

c) wherein said first lower end of said vertical planar member and said first extended end of said horizontal planar member are arcuate ends;

d) a non-slip surface, friction-engaging foam means at said first lower end of said vertical planar member and at said first extended end of said horizontal planar member to retain the support platform in position on an inclined surface, said foam means comprising a friction-engaging, deformable, arcuate-formed, plastic foam material; and e) adjusting means to secure said second secured end of said horizontal planar member to said vertical planar member, and to adjust and secure the desired height of said horizontal planar member to said vertical planar member based on the incline of the surface on which the support platform is to be used, to provide said horizontal, adjustably secured planar member at a right angle to said vertical planar member.

2. The platform of claim 1 wherein said non-slip surface, friction-engaging foam means comprises a flexible, slightly deformable, arcuate-formed, plastic foam material, with each foam means extending substantially across the width of said first lower end of said vertical planar member and said first extended end of said horizontal planar member.

3. The platform of claim 2 wherein said flexible foam means comprises a foam tubular member having a longitudinal slit, which member is removably snap-fitted to said first extended end of said horizontal planar member and said first lower end of said vertical planar member.

4. The platform of claim 1 wherein said foam member comprises a tubular friction foam member secured about each arcuate end.

5. The platform of claim 4 wherein said foam means is removably attached to said arcuate first lower end and first extended end.

6. The platform of claim 4 wherein said foam means is secured to said first lower end and to said first extended end by means of a double-faced adhesive tape.

7. The platform of claim 1 wherein said vertical planar member is characterized by at least one generally vertical slot with a recessed groove around its outer perimeter, and said horizontal planar member includes a brace element on its lower surface at said second secured end and having at least one hole therein, and which adjusting means comprises a threadable means extending through said hole of said brace element and said slot to permit the vertical height adjustment of said horizontal planar member on said vertical planar member and to secure threadably said vertical and horizontal planar members in a use position.

8. The platform of claim 7 wherein said vertical planar member comprises a pair of spaced apart, parallel slots and said brace element includes a pair of holes to match said slots.

9. The platform of claim 1 wherein said second upper end of said vertical planar member includes an open handle means for carrying said platform.

10. The platform of claim 1 wherein said vertical and horizontal planar members are comprised of a lightweight, integral, hard-molded plastic material.

11. In combination, an inclined surface which includes thereon the assembled platform of claim 1.

12. In combination, a ladder with rungs set at an angle, which includes the frictionally secured, assembled platform of claim 1 interlocked with the rungs of the ladder.

13. The platform of claim 1 which includes a plurality of openings in said horizontal planar member, one of which openings is circular to receive and retain a pail therein.

14. The support platform of claim 18 in a non-use compact position wherein said vertical planar member and said horizontal planar member are secured together in a generally parallel, close-fitting manner by said adjusting means.

15. An adjustable support platform for use on an inclined surface such as a roof or ladder, which support platform comprises:

a) a vertical planar member comprised of lightweight, hard-molded plastic material having a first lower arcuate end and a second upper end, said upper end having an open handle means, and wherein said vertical planar member includes at least a pair of spaced apart parallel, elongated, generally vertical slots therein;

b) a horizontal planar member comprised of lightweight, hard-molded plastic material having a first extended, arcuate end and a second secured end, said horizontal planar member adapted to be secured to and extending horizontally at a right angle from said vertical planar member in a vertical height-adjusting relationship;

c) a brace element on a lower surface at said second secured end of said horizontal planar member and having at least two holes therein to permit, in an assembled position, the slidable vertical height adjustment of said horizontal planar member on said vertical planar member and to permit said vertical and horizontal planar members to be retained together;

d) said horizontal planar member characterized by at least one opening in said horizontal planar member to receive and hold a pail or tools;

e) a non-slip surface, friction-engaging foam means comprised of deformable tubular foam material secured to said first lower arcuate end of said vertical planar member and extending substantially across the width of each end, and to said first extended arcuate end of said horizontal planar member to retain the support platform in position on an inclined surface; and f) threadable adjusting means extending through said holes and said slots to secure said horizontal planar member to said vertical planar member to adjust and secure the desired vertical height of said horizontal planar member to said vertical planar member based on the incline of the surface on which the support platform is used to provide said horizontal, adjustably secured planar member at a right angle to said vertical planar member.

16. In combination, an inclined surface which includes thereon the support platform of claim 15.

17. The support platform of claim 15 wherein said foam means comprises a snap-on polymeric foam material on said arcuate ends.

18. The support platform of claim 15 which includes double-side adhesive tape to secure said tubular foam material to said arcuate ends.

19. The support platform of claim 15 in a non-use, compact carrying position wherein said vertical planar member and said horizontal planar member are threadably secured together by said threadable adjusting means in a generally parallel, close-fitting manner, and said vertical planar member has a handle opening at one end adjacent the tubular foam member of said horizontal planar member.

* * * * *